US006382076B1

(12) United States Patent
Alvarez Garcia

(10) Patent No.: US 6,382,076 B1
(45) Date of Patent: May 7, 2002

(54) PISTON SERVO-ACTUATION MAIN SYSTEM WITH HYDROMECHANICALLY SELF-CONTAINED DETECTION

(75) Inventor: José Javier Alvarez Garcia, Madrid (ES)

(73) Assignee: Industria de Turbo Propulsores, S.A., Zamudio (Vizcaya) (ES)

( * ) Notice: Subject to any disclaimer, the term of this patent is extended or adjusted under 35 U.S.C. 154(b) by 0 days.

(21) Appl. No.: 09/379,241

(22) Filed: Aug. 23, 1999

(30) Foreign Application Priority Data

Aug. 24, 1998 (ES) ..... 9801795

(51) Int. Cl.[7] ..... F15B 9/03; F15B 13/044

(52) U.S. Cl. ..... 91/419; 91/459; 91/465; 91/468; 60/403

(58) Field of Search ..... 91/419, 459, 462, 91/463, 464, 465, 466, 467, 468; 60/403

(56) References Cited

U.S. PATENT DOCUMENTS 3,699,993 A * 10/1972 Herion et al. ..... 91/468 X
3,714,868 A * 2/1973 Kowalski et al. ..... 91/459 X
3,738,227 A * 6/1973 Bitzer et al. ..... 91/468 X
4,266,466 A * 5/1981 Ziems ..... 91/459 X
4,630,523 A * 12/1986 Tersteegen ..... 91/463 X
H249 H * 4/1987 Welford ..... 91/463 X
4,840,111 A * 6/1989 Garnjost ..... 91/459 X
4,896,553 A * 1/1990 Sato et al. ..... 91/459 X
5,148,735 A * 9/1992 Veletovac ..... 91/459
5,165,320 A * 11/1992 Ravn ..... 91/459 X
5,355,772 A * 10/1994 Shimada et al. ..... 91/459 X
5,615,594 A * 4/1997 Duckinghaus ..... 91/459 X
5,868,059 A * 2/1999 Smith ..... 91/459 X
6,047,628 A * 4/2000 Duckinghaus et al. ..... 91/459

* cited by examiner

*Primary Examiner*—John E. Ryznic
(74) *Attorney, Agent, or Firm*—Darby & Darby

(57) ABSTRACT

Main piston servo-actuation system, with hydromechanic self-contained failure detection device, working with hydraulic fluid supplied by a pump, including two servovalves (1 and 2) which are identical in design, controlling a piston (3) mechanically linked to a position transducer (4) according to the electrical demand (6, 7) supplied by the feedback position control loops (8 and 9) for the servovalves (1 and 2) to the torque motors (12 and 13) of the servovalves. These loops (8 and 9) receive the same piston position request, and they are given feedback at the same time with the same position signal fed by the position transducer (4). The system is furthermore compensated by two pressure selection valves (14 and 15) and by its own interconnection servo lines.

6 Claims, 4 Drawing Sheets

PISTON SERVO-ACTUATION MAIN SYSTEM WITH HYDROMECHANICALLY SELF-CONTAINED DETECTION

BACKGROUND OF THE INVENTION

1. Field of the Invention

The present invention refers to a piston servo-actuation main system, of electromechanical and hydraulic type, specially conceived for its use in global servo-actuation systems exhibiting the following characteristics: a) high reliability, b) minimum effect of the failures of the main system on its operation; c) fast and efficient main system failure detection, confirmation and compensation; d) easy logic in the dedicated control system; e) global servo-actuation system reversibility, i.e., ability to go back to normal operation mode should spurious failures occur, thus preventing loss of redundancy.

This invention refers to a piston servo-actuation main system, of electromechanical and hydraulic type, specially conceived for its use in global servo-actuation systems where are required aspects such as: a) high reliability, b) minimum effect of the failures of the main system on its operation; c) fast and efficient main system failure detection, confirmation and compensation; d) easy logic in the dedicated control system; e) global servo-actuation system reversibility, i.e. ability to go back to normal operation mode should spurious failures occur, thus preventing loss of redundancy.

The piston servo-actuation main system is to be connected to a pump able to provide it with hydraulic fluid pressurised flow. Such pressures and flows should be sufficient to enable system operation at any time.

2. Description of Related Art

Many different types of piston servo-actuation are known, most consisting of single or two stage and three or four way servovalves, depending upon the geometry and requirements of piston operation. Whenever a very high reliability of the global servo-actuation system is required, it is usual to provide it with a back-up servo-actuation system (active or inactive) which provides redundancy of the operation on main system failure events. Those failures are usually detected by the control system through the use of an actual piston position signal measured by means of a position transducer and a particular software logic which allows confirming the failure and then transferring control to the back-up system by electrical actuation of electro-hydromechanical components in the global actuation system.

SUMMARY OF THE INVENTION

The aim of the present invention is developing a piston main servo-actuation system which offers, in contrast with the methods mentioned above, a self-contained failure detection logic allowing the introduction of a back-up actuation system without any need for the electronic control system to play any role in the process, thus preventing any problem associated to the typical ways electronic controls systems accomplish the detection, confirmation and compensation of main system failures. In the event of a main system failure the reaction against it would then be self-contained and the only effect on the system would be loss of redundancy of the affected function. This system also allows testability of the electromechanical components it consists of either before or after every operating cycle so as to ensure complete availability of the system to perform next cycle.

The objective claimed above is basically achieved, according to the present invention, by means of a piston servo-actuation system of the type described above consisting, in opposition to the typical systems, of two servovalves of the same design, fed by a high pressure supply line and a low pressure spill line, which position a piston mechanically linked to a position transducer, according to the electrical demand supplied by the position feedback control loops to the torquemotors of the servovalve. These control loops receive the piston position demands and are both fed back with the position signal supplied by the position transducer. Each servovalve is provided with a control line which are connected to opposite sides of the piston, thus forming a hydraulic bridge configuration formed by the control lines regulated by the servovalve restrictions. The system is completed with two similar design pressure select valves featuring spool type, four-way, constant area and balanced against either springs, which receive pressure from opposite sides relative to their springs of a working line, set by the supply line and the spill line pressures by means of a potentiometer. The two pressure select valve will control in parallel as a function of their positions if the supply line, fed to the select valves, will be connected to the outlet line, or state line, which will stay either at low pressure of the spill line via a connection through a restriction or at high pressure of the supply line, which may serve as a criteria to, by means of other methods different to this invention, either transfer piston control to an alternative system, disconnecting the system described, or else transfer control completely, including piston and position transducer, to an alternative system.

Should the servovalves be three-way, either single or two stage, both servovalve control lines, one from each, connected to opposite sides of the piston, will be provided with extensions which will act as reference lines connected to the free side of the select valves opposite to that receiving the working line.

Should the servovalves be four-way, either single or two stage, two separate hydraulic bridge configurations would be obtained; one formed by the two control lines of the servovalves which are connected to opposite sides of the piston, the other formed by the other two control lines of the servovalves, joined each other in a short-circuited hydraulic bridge by means of a line acting as a reference and connected to the two free sides of the select valve opposite to those receiving the working line.

The constitution and features of this invention, such as they are covered in the claims as well as the advantages obtained could better be understood with the following description, made with a reference to the figures attached, in which it is shown in a schematic way and as non limiting instance possible ways of implementation.

DETAILED DESCRIPTION OF THE INVENTION

Figure 1:
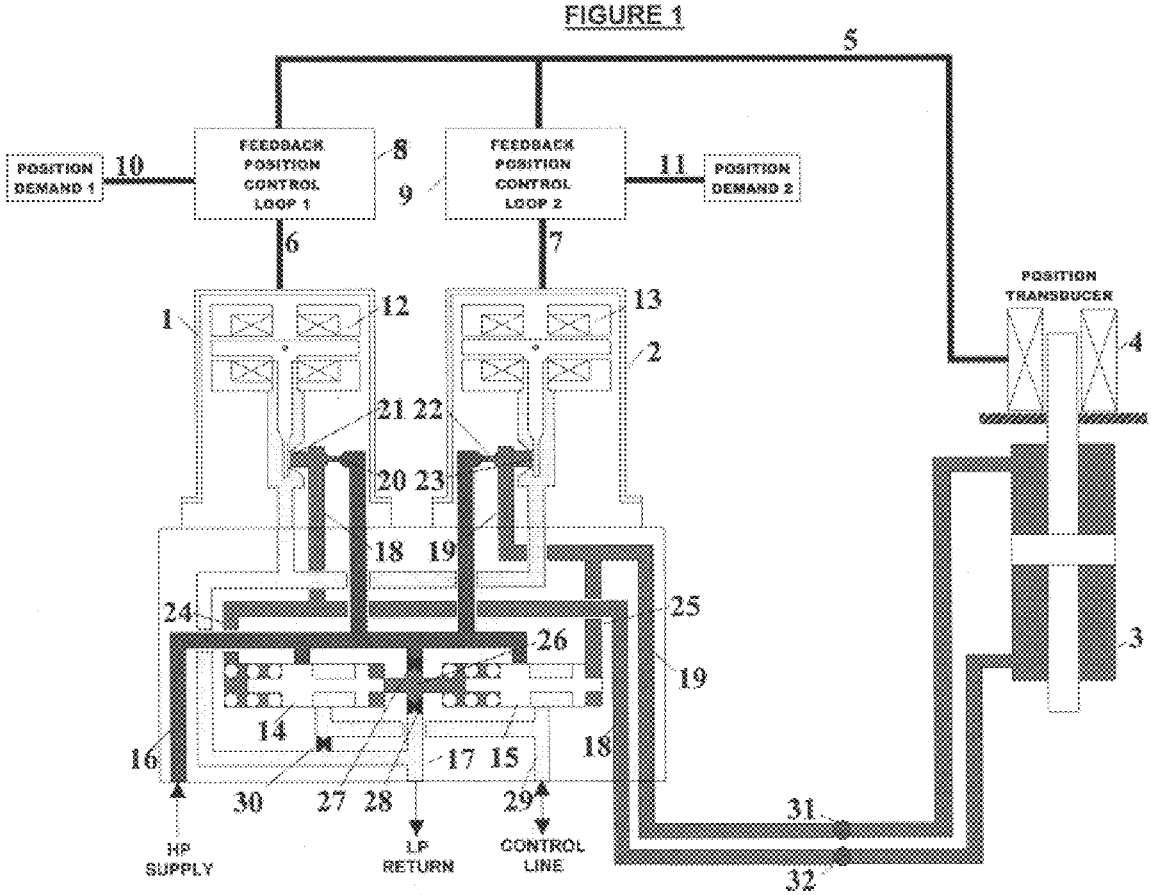
FIG. 1 is a scheme of a piston servo-actuation system including two single-stage, three-way servovalves.

The piston servo-actuation main system works with hydraulic fluid provided by a pump and consists of two servovalves 1, 2 which position a piston 3, which is mechanically linked to a transducer to measure its position 5 electrically, as a function of the electrical demands 6, 7, supplied by their dedicated feedback position control loops 8, 9 as a function of the piston position demands 10, 11 to their dedicated torquemotors of the servovalves 12, 13; the system being completed with two pressure select valves 14, 15, and the corresponding interconnecting servo circuits.

Figure 3:
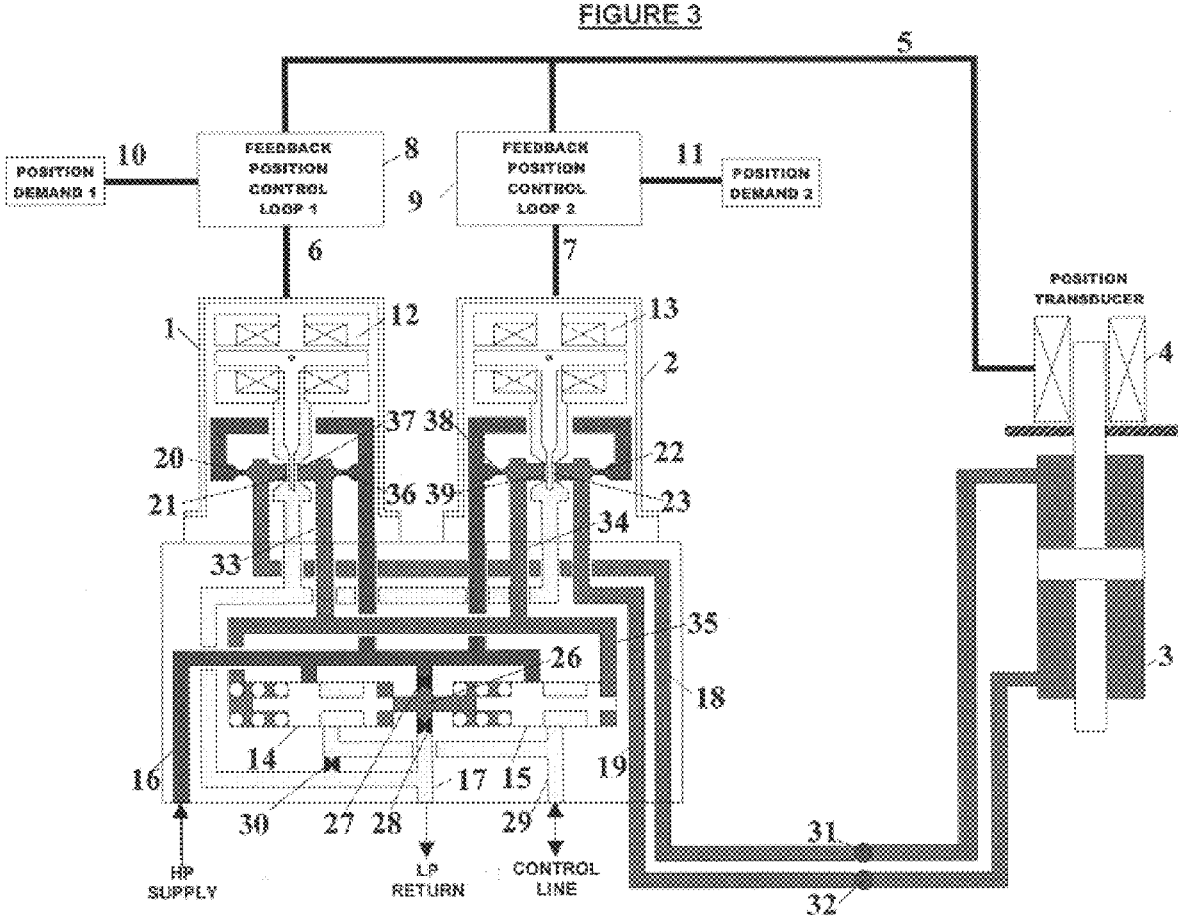
FIG. 3 is a similar scheme to FIG. 1, but including single-stage, four-way servovalves.
Figure 4:
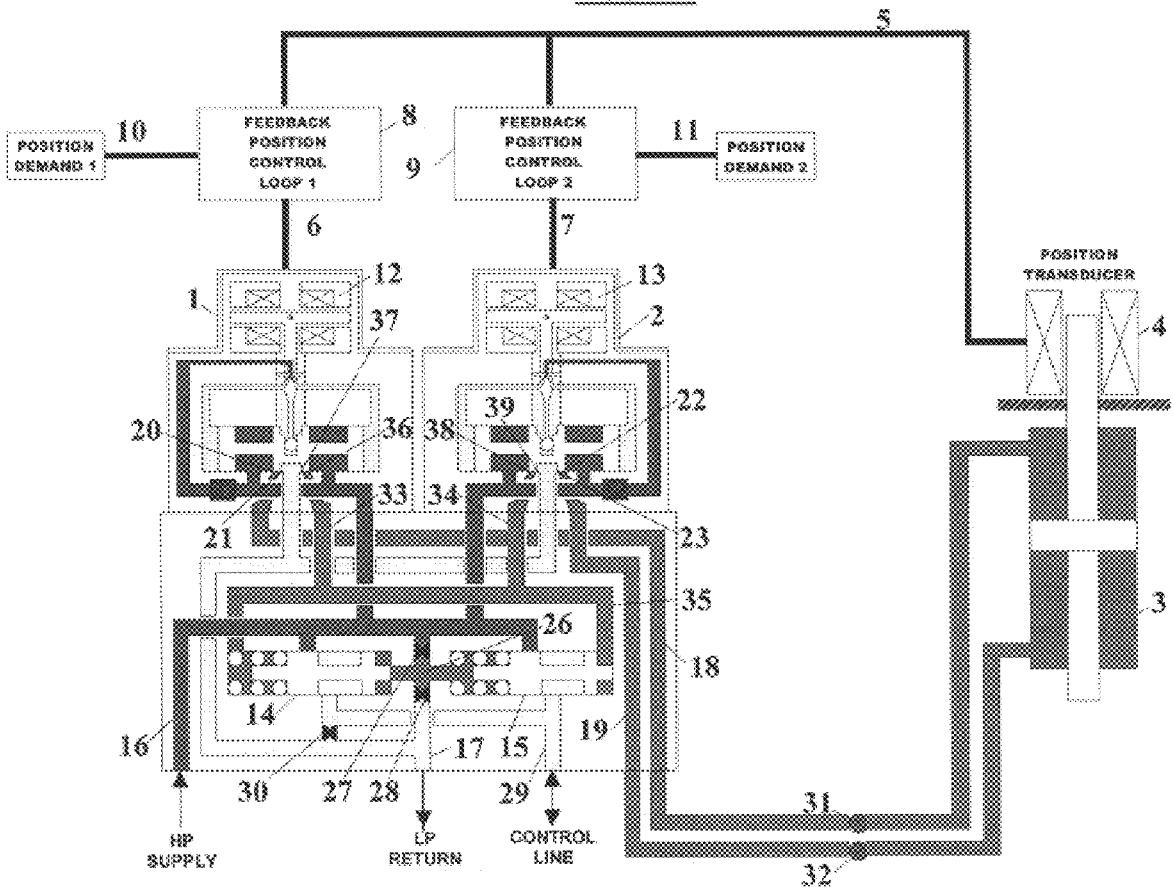
FIG. 4 is a similar scheme to FIG. 1, but including two-stage, four-way servovalves.

The servovalves 1, 2 may be: a) single-stage, three-way (FIG. 1); b) two-stage, three-way (FIG. 2); c) single-stage, four-way (FIG. 3); d) two-stage, four-way (FIG. 4). The functional descriptions which follow are applicable not only to single-stage but also to two-stage servovalves. The use of one or the other type will depend upon the functional characteristics required. The use of three or four way servovoalves will however modify both system configuration and some functional aspects of the system. The descriptions that follow will therefore distinguish one type from the other, also mentioning the differences between both.

Figure 2:
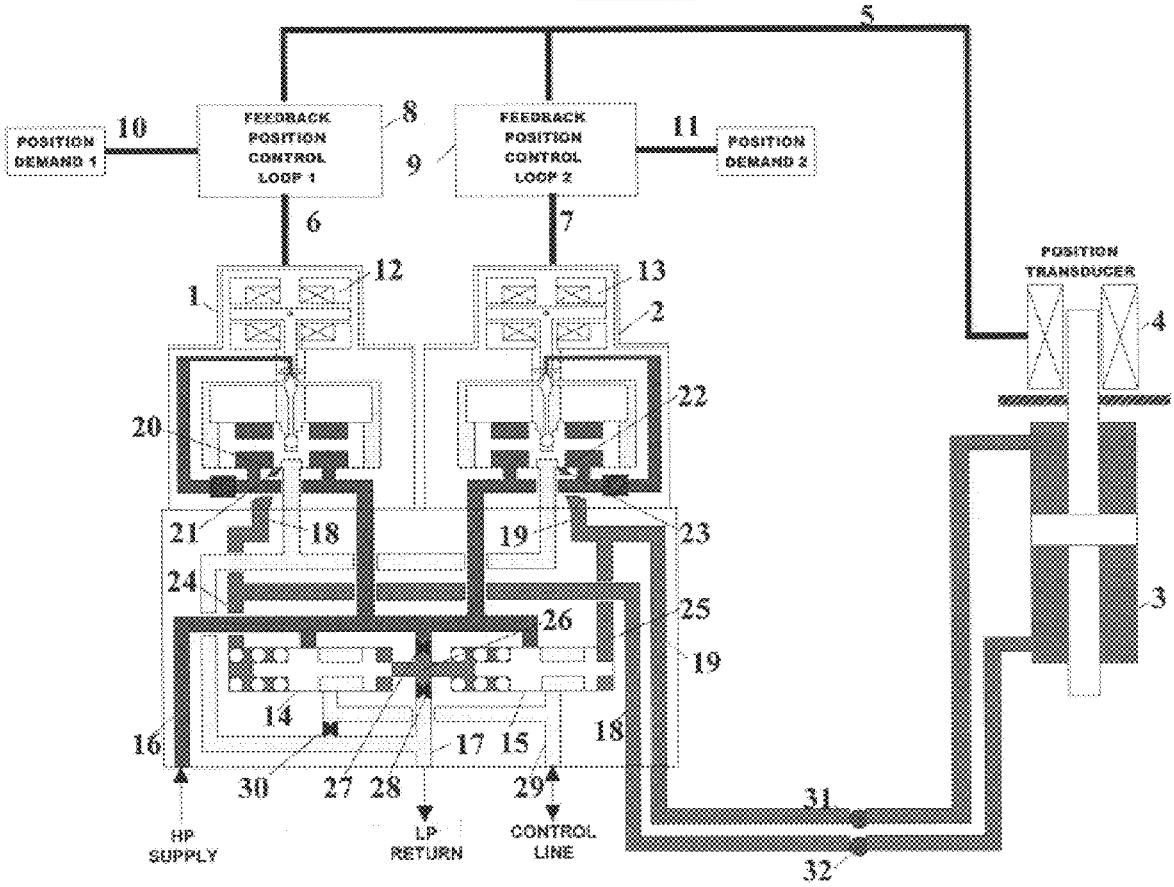
FIG. 2 is a similar scheme to FIG. 1, but including two-stage, three-way servovalves.

A) System with Three-way Servovalves 1, 2 (FIGS. 1 and 2)

This type of system is designed for the actuation of a piston with either no external loads applied or negligible external loads applied compared to the hydraulic loads generated by the servovalves (friction loads, etc.).

This system will be able to detect and self-compensate for any single failure of any feedback position control loop, any servovalve or leakage or seizure of the piston, as follows.

The respective torquemotors 12, 13 of the two servovalves 1, 2 have identical electro-hydromechanical design characteristics and are controlled, respectively, by a control system with identical feedback position control loops of piston 3, i.e. loop 8 for servovalve 1 and loop 9 for servovalve 2, supplied with the same position demand 10, 11 and fed back both simultaneously with the same position signal 5 of piston 3 supplied by the position transducer 4, mechanically linked to piston 3.

Both servovalves 1, 2 are fed with the same hydraulic supply circuit connected to the high pressure supply line, supply pressure 16, and to the low pressure line, return pressure 17, of the pump supply, which provides the hydraulic pressure and flow needed for an adequate control of servovalves 1, 2. Each servovalve is provided with a single control line: line 18 for servovalve 1 and line 19 for servovalve 2.

The function of the control line in each servovalve will consist in controlling the position of piston 3 by means of connecting line 18 from the servovalve 1 to line 19 from the servovalve 2 to opposite sides.

Control lines 18, 19 from servovalves 1, 2 will be placed in opposite sides relative to the actuation of the torquemotors 12, 13 (this may be accomplished by either opposite physical positioning of the control lines relative to the torquemotors or else by polarity inversion of the electrical circuit feeding the torquemotor windings). The aim of this configuration is the following: piston 3 is normally controlled in position as a function of the same electrical demand in 6, 7 coming from the feedback position control loops 8, 9 to their respective servovalves 1, 2 since the feedback loops 8, 9 are physically identical and are supplied with the same position 5 from the transducer 4, and the same position demand in 10, 11. The servovalves 1, 2 act together as if it was only one servovalve, as it retains the same hydraulic bridge configuration formed by: a) lines 16, 18, 17 controlled by restrictions 20, 21 in servovalve 1; b) lines 16, 19, 17 controlled by restrictions 22, 23 in servovalve 2. Furthermore, as the piston is, in normal conditions, not subjected to significant loads, the pressure in lines 18, 19 will be very similar.

Lines 24, 25 are extensions of control lines 18, 19 from servovalves 1, 2 and will serve as a reference for checking system condition by the operation of the pressure select valves 14, 15. Pressure in lines 24, 25 will respectively be alike to those in lines 18, 19 and very similar, as mentioned above.

The pressure select valves 14, 15 receive pressure from the working line 26 obtained with the supply pressure 16 and return pressure 17 by means of restrictions 27, 28. The aim of the is line is reproducing the reference pressure in lines 24, 25 when both servovalves 1, 2 are operative. This may be accomplished if the control line is not loaded as the hydraulic bridge is created. When the servovalves are operative, the sum of the flow number of the restrictions 20, 22 and the sum of the flow number of the restrictions 21, 23 in the servovalves are going to be respectively constant (servovalve design condition). The fixed restrictions 27, 28 should be assigned a value such that the pressure in line 26 is the same as that for the summed restrictions 20+22 and 21+23 in lines 24 and 25, i.e. their values squared should be kept at the same rate.

The pressure select valves 14, 15 are identical in design and are configured in the following way: a) pressure select valve 14 receives pressure from the working line 26 on one side and pressure from the reference line 24 and spring load on the other; b) pressure select valve 15 receives pressure from the working line 26 and spring load on one side and pressure from the reference line 25 on the other.

In normal working system conditions, the pressure in reference lines 24, 25 is going to be nominally alike the pressure in the working line 26, so the pressure select valves 14, 15 are going to be balanced against the stop shown in FIGS. 1 and 2 due to the spring load. In this condition, the pressure select valves 14, 15 keep the supply line 16 disconnected from the state line 29, which will be at low pressure from the return line through restriction 30.

If one of the servovalves fails to follow the piston position demand because either the feedback position control loop or the servovalve itself have failed the pressure in the reference lines 24, 25 will deviate from its nominal value either to upper or lower values depending on the type of failure. Simultaneously, a flow imbalance through control lines 18, 19 will occur which will force the piston 3 to travel in the direction congruent with the failed servovalve. This deviation in the position of the piston 3 will introduce a position error in the feedback position control loops 8, 9 which will make the operative servovalve try to oppose the failure. This opposition has two consequences: a) the piston 3 will tend to move back to its original position, will stop moving or will slow down (depending on the type of failure); b) the pressure imbalance in the reference lines 24, 25 will be made bigger, further deviating off its nominal value. If the pressure imbalance is such that the pressure in the reference lines 24, 25 is out of a boundary set by the spring preload of the pressure select valve 14, 15 centred in the nominal working pressure of the hydraulic bridge circuit of the working line 26, one of the select valves (select valve 14 if the pressure deviation is over the lower side of the boundary or select valve 15 if the pressure deviation is over the upper side of the boundary) will modify its balance travelling to its alternative stop position which will as a consequence open a connection from the supply line 16 to the state line 29 rising the pressure value in this line from its usual value of return pressure 17 to the supply pressure 16.

If the piston 3 fails stuck at a certain position, any attempt of the control system to achieve different positions to piston 3, by demanding the servovalves 1, 2 to position their torquemotors 12, 13 such that they try to move the piston in the required direction, will fail. The effect created will however be a pressure imbalance in the reference lines 24, 25 each other and of both with respect to the nominal pressure in the working line 26 in opposite direction. This pressure imbalance will make at least one of the select valves 14, 15 modify its balanced position traveling to its alternative stop which creates as a consequence a connection from the supply line 16 to the state line 29 raising the pressure in this line from its usual return pressure 17 value to supply pressure 16.

The signal of the state line 29 may be used as a criteria to initiate the control transfer sequence from this main servo-actuation system to a back-up servo-actuation system. This transfer must be accomplished by elements of the global servo-actuation system which are not the subject of this invention. The transfer may be: 1) partial, keeping piston 3 and position transducer 4 as part of the backup servo-actuation system, i.e. disconnecting control lines 18, 19 from the piston 3 in points 31, 32 and connecting those points to the control lines of the back-up servo-actuation system; 2) total, where the back-up servo-actuation system has its own piston and position transducer should this be the case, the control transfer should be made between the outlet functions of both pistons. The type of transfer made will be greatly dependent upon the reliability of the piston used. If the potential of this invention needs to be used to override, e.g., possible piston seizures, the use of the type of transfer indicated in point 2) is recommended.

B) System with Four-way Servovalves 1 and 2 (FIGS. 3 and 4)

This type of system is designed for the actuation of a piston subjected to any loading and will be able to detect and self-compensate for any single failure in the feedback position control loop or any servovalve.

The principle of operation of this system is very similar to that of three-way servovalves 1, 2 in FIGS. 1 and 2 and as such the description made in section A) is most applicable. The description that follows will therefore only concentrate around those aspects in which both systems differ.

In this system, each servovalue 1, 2 is provided with two control lines; line 18, 33 for servovalve 1 and lines 19, 34 for servovalve 2.

Similarly to system A), the connection of line 18 from servovalve 1 and line 19 from servovalve 2 to opposite sides of the piston 3 will be made to control its position and will act together as if a single servovalve was used with the same hydraulic bridge configuration described in A). Lines 18, 19 are not going however to set the reference pressure feeding select valves 14, 15. The pressure in the control lines 18, 19 will not be necessarily similar to each other but they will depend upon the loads acting on piston 3.

The function of the other control line in each servovalve will consist in serving as a reference to check system condition by means of the following hydraulic configuration: Line 33 from servovalve 1 and line 34 from servovalve 2 will be joined to form a common reference line 35 to be used for the operation of the pressure select valves 14, 15.

The pressure in reference line 35 formed by joining control lines 33, 34 will be a function of the same electrical demand in 6, 7 from the piston feedback position control loops 8, 9 to their dedicated serbvovalves 1, 2, since the feedback loops 8, 9 are physically identical and are provided with the same position 5 from the transducer 4 and the same position demand in 10, 11. The servovalves 1, 2 act together as if a single servovalve without load was used, as it has the same hydraulic bridge configuration formed by: a) lines 16, 33, 17 controlled by restrictions 36, 37 in servovalve 1; b) lines 16, 34, 17 controlled by restrictions 38, 39 in servovalve 2. The level of pressure in the reference line 35 will correspond to the design value of a servovalve operating without load.

The pressure select valves 14, 15 are going to receive pressure from the working line 26 in the same fashion as in system A), though in this case, the aim of this line is reproducing the reference pressure in line 35 when both servovalves 1, 2 are operative. When the servovalves are operative, the sum of the flow number of the restrictions 36, 38 and the sum of the flow number of the restrictions 37, 39 in the servovalves are going to be respectively constant (servovalve design condition). The fixed restrictions 27, 28 should be assigned a value such that the pressure in line 26 is the same as that for the summed restrictions 36+38 and 37+39 in line 35, i.e. their values squared should be kept at the same rate.

The pressure select valves 14, 15 are identical in design and are configured in the following way: a) pressure select valve 14 receives pressure from the working line 26 on one side and pressure from the reference line 35 and spring load on the other; b) pressure select valve 15 receives pressure from the working line 26 and spring load on one side and pressure from the reference line 35 on the other.

In normal working system conditions, the pressure in reference line 35 is going to be nominally alike the pressure in the working line 26, so the pressure select valves 14, 15 are going to be balanced against the stop shown in FIGS. 3 and 4 due to the spring load.

If one of the servovalves fails to follow the piston position demand because either the feedback position control loop or the servovalve itself have failed the pressure in the reference lines 35 will deviate from its nominal value either to upper or lower values depending on the type of failure and the effect will be the same as described in section A) for reference lines 24, 25.

A piston 3 failed stuck will not be detected or compensated by this system. If that detection was necessary, it should be made by means other than the one in this patent.

What is claimed is:

1. A piston main servo-actuation system comprising:

a piston;

a position transducer mechanically connected to the piston for producing a piston position signal;

two feedback position control loops each receiving as input the piston position signal and piston position demands and producing an electrical demand output signal;

two servovalves, identical in design and having a torque motor, the servovavles positioning the piston in response to the electrical demand output signal received from the respective control loops, the servovavles being fed by a high pressure supply line and a low pressure return line, each servovalve having an output control line connected to opposite sides of the piston and creating a hydraulic bridge configuration formed by (i) the high pressure supply line, the low pressure return line and the control line of one servovalve controlled by a first set of restrictions, and (ii) the high pressure supply line, the low pressure return line and the control line of the other servovalve controlled by a second set of restrictions; and two pressure select valves each being balanced at one end by a spring load and pressure from a reference line and at an opposite end by a working line, the pressure select valves being set with pressure from the supply line and return line through a third set of restrictions.

2. The system in accordance with claim 1, wherein the pressure select valves are four-way spool pressure valves identical in design and constant in area.

3. The system in accordance with claim 1, wherein the servovalves are single-stage three-way servovalves and the control lines thereof being connected to opposite sides of the piston, the respective control lines being connected to the respective reference lines that, in turn, are connected to the respective pressure select valves opposite to the end receiving the working line.

4. The system in accordance with claim 1, wherein the servovalves are two-stage three-way servovalves, and the control lines thereof being connected to opposite sides of the piston, the respective control lines being connected to the respective reference lines that, in turn, are connected to the respective pressure select valves opposite to the end receiving the working line.

5. The system in accordance with claim 1, wherein the servovalves are single-stage four-way servovalves so as to form separate hydraulic bridge configurations, a first hydraulic bridge being formed by two control lines of the servovalves connected to opposite sides of the piston, a second hydraulic bridge being formed by the other two control lines of the servovalves, the servovavles being joined via a short-circuited hydraulic bridge connecting ends of the servovalves opposite the respective ends receiving the working line.

6. The system in accordance with claim 1, wherein said servovalves are two-stage four-way servovalves, so as to form separate hydraulic bridge configurations, a first hydraulic bridge being formed by two control lines of the servovalves connected to opposite sides of the piston, a second hydraulic bridge being formed by the other two control lines of the servovalves, the servovavles being joined via a short-circuited hydraulic bridge connecting ends of the servovalves opposite the respective ends receiving the working line.

* * * * *